US008123348B2

(12) United States Patent
Igi et al.

(10) Patent No.: US 8,123,348 B2
(45) Date of Patent: Feb. 28, 2012

(54) RECORDING APPARATUS

(75) Inventors: Hisashi Igi, Nagoya (JP); Junji Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 313 days.

(21) Appl. No.: 12/395,223

(22) Filed: Feb. 27, 2009

(65) Prior Publication Data

US 2009/0219372 A1 Sep. 3, 2009

(30) Foreign Application Priority Data

Feb. 28, 2008 (JP) ..... 2008-047658

(51) Int. Cl.
*B41J 2/01* (2006.01)

(52) U.S. Cl. ..... 347/102; 347/104; 347/101

(58) Field of Classification Search ..... 347/102, 347/101, 103, 104
See application file for complete search history.

(56) References Cited

U.S. PATENT DOCUMENTS

| | | | | |
|---|---|---|---|---|
| 4,463,361 | A * | 7/1984 | Koumura et al. | 346/134 |
| 6,390,618 | B1 * | 5/2002 | Wotton et al. | 347/102 |
| 6,663,238 | B2 * | 12/2003 | Kikuchi et al. | 347/102 |
| 2002/0126191 | A1 * | 9/2002 | Fujioka | 347/104 |
| 2004/0245711 | A1 * | 12/2004 | Domoto et al. | 271/197 |
| 2005/0212883 | A1 | 9/2005 | Okamoto | |
| 2006/0001721 | A1 * | 1/2006 | Yraceburu et al. | 347/102 |
| 2007/0008394 | A1 | 1/2007 | Mashima | |

FOREIGN PATENT DOCUMENTS

| | | | |
|---|---|---|---|
| JP | H06-055731 | A | 3/1994 |
| JP | 2001239712 | A * | 9/2001 |
| JP | 2002113923 | A * | 4/2002 |
| JP | 2005-271278 | A | 10/2005 |
| JP | 2007-015130 | A | 1/2007 |
| JP | 2007090835 | A * | 4/2007 |
| JP | 2007-144830 | A | 6/2007 |

OTHER PUBLICATIONS

Machine Translation for JP 06-055731 (Mar. 1, 1994).*

* cited by examiner

*Primary Examiner* — Stephen Meier
*Assistant Examiner* — Leonard S Liang
(74) *Attorney, Agent, or Firm* — Baker Botts L.L.P.

(57) ABSTRACT

A recording apparatus includes a recording unit that forms an image on a recording medium, a recording medium conveying unit, which confronts the recording unit, and which includes a recording medium supporting surface including a hole, a suction unit that draws air through the hole to draw the recording medium in order to stick the recording medium to the recording medium supporting surface, and a re-conveying unit that re-conveys the recording medium to an upstream of the recording medium conveying unit in a conveying direction, wherein the suction unit discharges air toward the recording medium that is being conveyed by the re-conveying unit.

14 Claims, 5 Drawing Sheets

RECORDING APPARATUS

CROSS-REFERENCE TO RELATED APPLICATIONS

This application claims priority from Japanese Patent Application No. 2008-047658 filed on Feb. 28, 2008, the entire subject matter of which is incorporated herein by reference.

TECHNICAL FIELD

The present invention relates to a recording apparatus which records an image on a recording medium.

BACKGROUND

A known inkjet recording apparatus includes recording heads, a conveyance belt for conveying a sheet fed out from a sheet feeding tray to a position where the sheet confronts the recording heads, a charging mechanism for electrostatically charging the conveyance belt so as to stick the sheet to the conveyance belt electrostatically, a double-side conveyance belt for conveying a sheet which has already been printed on one side thereof and an air blower unit. In the inkjet recording apparatus, the air blower unit blows air to the recording surface of the sheet, which is being conveyed by the double-side conveyance belt, so as to promote the drying speed of the sheet.

SUMMARY

Illustrative aspects of the invention provide a recording apparatus which promotes drying of an image formed on a recording medium.

DETAILED DESCRIPTION

General Overview

Figure 1:
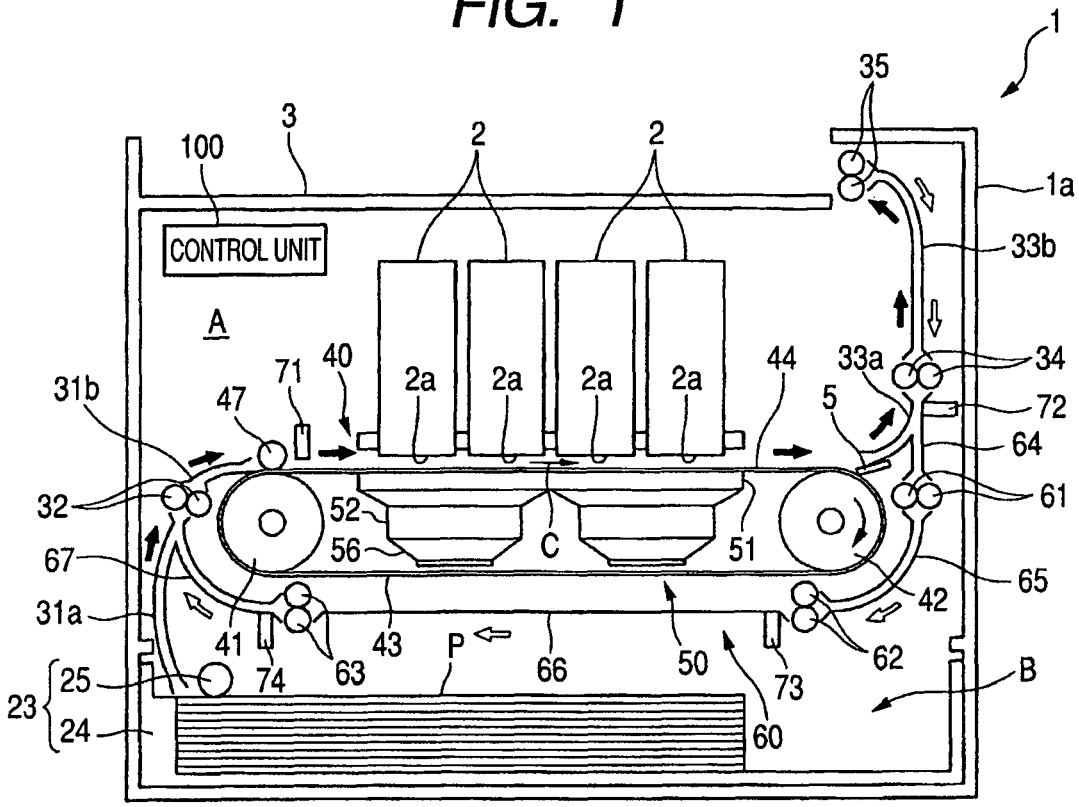
FIG. 1 is a schematic side view of an inkjet printer according to an exemplary embodiment of the invention.

The related art inkjet recording apparatus described above has some disadvantages. For example, the air blower unit is provided separately from the charging mechanism for electrostatically sticking the sheet to the conveyance belt. Thus, the number of components of the recording apparatus is increased.

Therefore, illustrative aspects of the invention provide a recording apparatus which promotes drying of an image formed on a recording medium while suppressing an increase in the number of components of the recording apparatus.

According to an first aspect of the invention, there is provided a recording apparatus comprising: a recording unit that forms an image on a recording medium; a recording medium conveying unit, which confronts the recording unit, and which comprises a recording medium supporting surface including a hole; a suction unit that draws air through the hole to draw the recording medium in order to stick the recording medium to the recording medium supporting surface; and a re-conveying unit that re-conveys the recording medium to an upstream of the recording medium conveying unit in a conveying direction, wherein the suction unit discharges air toward the recording medium that is being conveyed by the re-conveying unit.

According to a second aspect of the invention, in the recording apparatus, wherein the recording medium conveying unit comprises a conveying part, a surface of which includes the recording medium supporting surface, and which has an endless shape, and wherein the suction unit comprises a rotary fan that is provided inside of the conveying part.

According to a third aspect of the invention, in the recording apparatus, wherein the recording medium conveying unit comprises a first side that confronts the recording unit and a second side that is opposite to the first side, wherein the surface of the conveying part comprises a plurality of holes, and wherein the suction unit discharges air through holes of the plurality of holes provided on the second side.

According to a fourth aspect of the invention, in the recording apparatus, wherein the re-conveying unit is provided in a position where the re-conveying unit lies adjacent to the conveying part and where the conveying part is sandwiched between the recording part and the re-conveying unit.

According to a fifth aspect of the invention, in the recording apparatus, wherein the re-conveying unit conveys the recording medium at a first speed in a position where air is discharged from the suction unit toward the recording medium, wherein the re-conveying unit conveys the recording medium at a second speed in a position where air is not discharged from the suction unit toward the recording medium, and wherein the first speed is made slower than the second speed.

According to a sixth aspect of the invention, in the recording apparatus, wherein the suction unit comprises: a rotary fan comprising a fan-side discharge opening; and a duct that introduces air from the fan-side discharge opening to the re-conveying unit.

According to a seventh aspect of the invention, in the recording apparatus, wherein the duct comprises a duct-side discharge opening, which has a length equal to or longer than a length of a recording medium in a direction orthogonal to the conveying direction.

According to an eighth aspect of the invention, in the recording apparatus, wherein the duct comprises a duct-side discharge opening, an opening area of the duct-side discharge opening being smaller than an opening area of the fan-side discharge opening.

According to a ninth aspect of the invention, in the recording apparatus, wherein the suction unit comprises a heater that heats air which is discharged toward the recording medium conveyed by the re-conveying unit.

According to a tenth aspect of the invention, in the recording apparatus, wherein the suction unit comprises a plurality of rotary fans and a plurality of fan-side discharge openings, and wherein the plurality of fan-side discharge openings are aligned along the conveying direction.

According to an eleventh aspect of the invention, in the recording apparatus, wherein the suction unit comprises: a first side that confronts the recording unit; a second side that is opposite to the first side and confronts the re-conveying unit; and a rotary fan that sucks air from the first side and discharges the air toward the second side.

According to a twelfth aspect of the invention, in the recording apparatus, wherein the suction unit further comprises: a suction hole provided in the first side; and a discharge opening provided in the second side, and wherein the rotary fan is provided between the suction hole and the discharge opening.

According to a thirteenth aspect of the invention, in the recording apparatus, wherein the recording medium supporting surface comprises a plurality of holes, wherein the suction unit comprises a plurality of suction holes, and wherein an opening area of each of the plurality of holes is made smaller than an opening area of each of the plurality of suction holes.

According to the aspects of the invention, by making use of the suction unit for drawing a recording medium so as to cause it to stick to the recording medium supporting surface, air can be discharged toward the recording medium which is being conveyed by the re-conveying so as to promote drying of the image formed on the recording medium. Thus, the necessity is obviated of providing separately a device for promoting an image on a recording medium. According thereto, it makes possible to suppress an increase in the number of components of the recording apparatus.

According to the second aspect of the invention, the inside of the conveying part can effectively be used. Thus, it makes possible to reduce a size of the recording apparatus.

According to the third aspect of the invention, the air introduction line for introducing air discharged from the rotary fan to the re-conveying mechanism can be made simple. That is, the necessity of a duct can be obviated which causes air discharged from the rotary fan to bypass the holes.

According to the fourth aspect of the invention, the air introduction line can be made simple which introduces air discharged from the rotary fan to the re-conveying mechanism.

According to the fifth aspect of the invention, the drying of an image formed on a recording medium is promoted further.

According to the sixth aspect of the invention, air can effectively be discharged from the suction unit toward the recording medium which is being conveyed by the re-conveying mechanism.

According to the seventh aspect of the invention, air can be discharged over the whole of a recording medium with respect to the direction which is at right angles to the recording medium conveying direction.

According to the eighth aspect of the invention, a discharge speed of air discharged from the discharge opening of the duct can be increased, thereby making it possible to promote further drying of an image formed on a recording medium.

According to the ninth aspect of the invention, the drying of an image formed on a recording medium can be promoted further.

According to the tenth aspect of the invention, when the size of a sheet P is large, the plurality of rotary fans can be driven, while the size of the sheet P is small, only one of the rotary fans can be driven. That is, one or the plurality of rotary fans can be driven depending upon the size of the sheet P, this contributing to conservation of electric power.

According to the recording apparatus of the invention, by making use of the suction unit for drawing a recording medium so as to cause it to stick to the recording medium supporting surface, air can be discharged toward the recording medium which is being conveyed by the re-conveying so as to promote drying of the image formed on the recording medium. Because of this, the necessity is obviated of providing separately a device for promoting an image on a recording medium, thereby making it possible to suppress an increase in the number of components of the recording apparatus.

Exemplary Embodiments

Exemplary embodiments of the invention will now be described with reference to the drawings.

Referring to FIG. 1, an inkjet printer 1 (one example of a recording apparatus) includes a rectangular parallelepiped housing 1*a*, and a sheet discharging part 3 is provided at an upper portion in the housing 1*a*. An interior of the housing 1*a* is divided sequentially from the top into two spaces A, B. In the space A, four inkjet heads 2 (each of which is one example of a recording unit) which discharge individually magenta, cyan, yellow and black inks, a conveying unit 40 (one example of a recording medium conveying unit) and a re-conveying unit 60 are sequentially provided. In the space B, a sheet feeding unit 23 is provided. Further, the inkjet printer 1 includes a control unit 100 for controlling operations of components of the inkjet printer 1.

In the interior of the inkjet printer 1, the inkjet printer 1 includes a sheet conveying line along which a sheet P (one example of a recording medium) is conveyed from the sheet feeding unit 23 toward the sheet discharging part 3 along thick black arrows shown in FIG. 1 and a sheet re-conveying line along which the sheet P which has been conveyed along the sheet conveying line is then conveyed along thick white arrows shown in FIG. 1. The sheet feeding unit 23 has a sheet feeding cassette 24 which can accommodate a pile of stacked sheets P, a feed roller 25 for feeding out a sheet P from the sheet feeding cassette 24 and a sheet feeding motor 121 (refer to FIG. 4) for rotating the feed roller 25.

The feed roller 25 feeds out a topmost sheet P of the pile of sheets P accommodated in the sheet feeding cassette 24 by being brought into rolling contact with the topmost sheet P. In FIG. 1, conveyance guides 31*a*, 31*b*, which extend from the sheet feeding cassette 24 toward the conveying unit 40 while being curved, and a pair of forwarding rollers 32, which is provided between both the conveyance guides 31*a*, 31*b*, are provided to the left of the conveying unit 40. Note that one of the pair of forwarding rollers 32 is driven to rotate by a forwarding motor 122 (refer to FIG. 4), while the other of the pair is an idler or driven roller which rotates in conjunction with rotation of the one roller. In addition, the sheet feeding motor 121 and the forwarding motor 122 are controlled by the control unit 100.

In this configuration, by the sheet feeding roller 25 and the pair of forwarding rollers 32 being controlled to rotate by the control unit 100, a sheet P which is in rolling contact with the feed roller 25 is fed out to the conveyance guide 31*a*. Thereafter, the sheet P is conveyed to the conveyance guide 31*b* while being held between the pair of forwarding rollers 32 for further convey to the conveying unit 40.

The conveying unit 40 is a device which has two belt rollers 41, 42, a conveyance belt 43 (one example of a conveying part) which is looped round both the rollers 41, 42 in such a manner as to extend therebetween, and a conveying motor 123 (refer to FIG. 4) for rotating the belt roller 42, so as to convey a sheet P in a conveying direction C (a direction indicated by an arrow C in FIG. 1).

Figure 2:
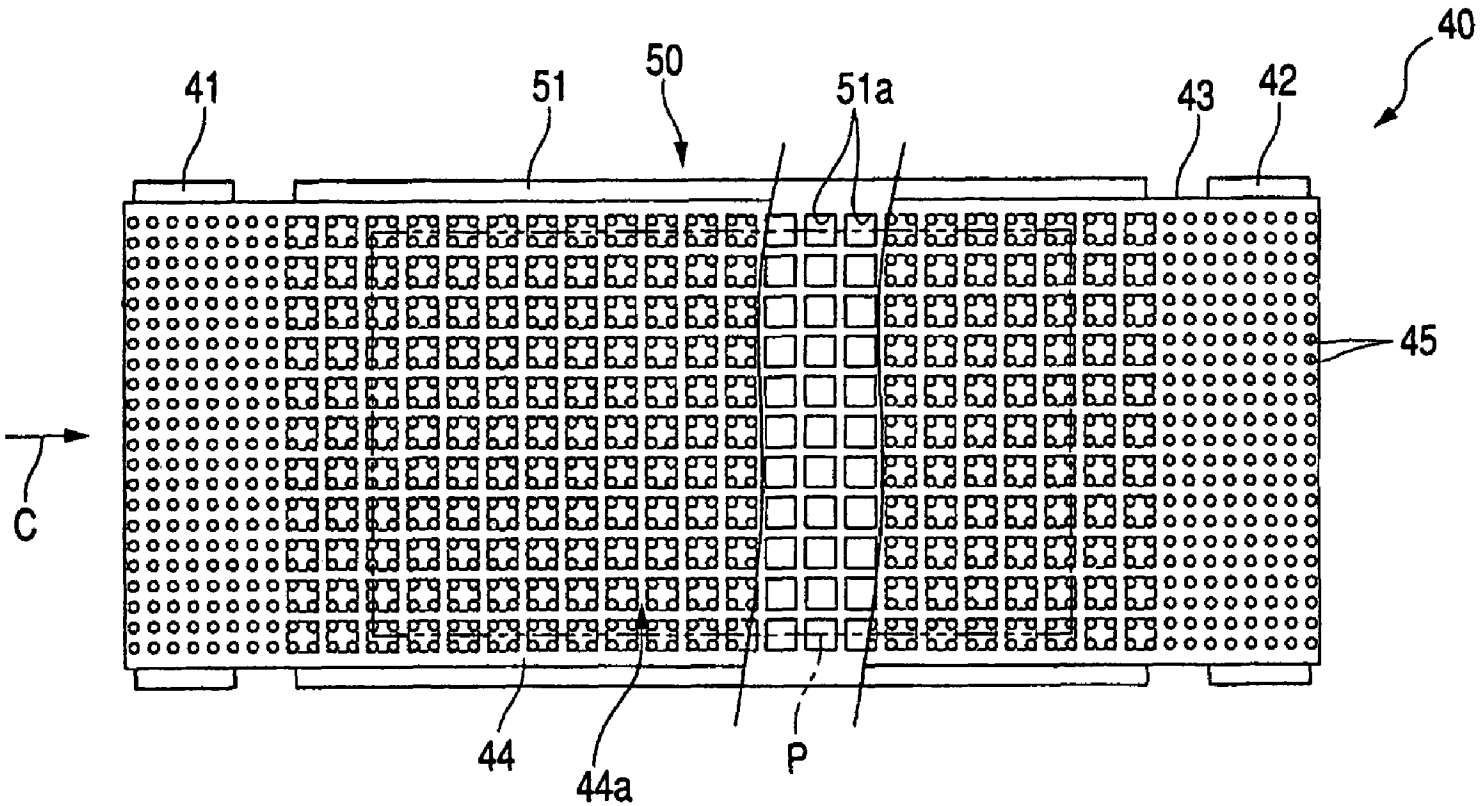
FIG. 2 is a plan view of a conveying unit and a suction unit which are shown in FIG. 1.

In the conveyance belt 43, as is shown in FIG. 2, a plurality of holes 45 are formed on an outer circumferential surface 44 (one example of a surface of the conveying part) which supports a sheet P in such a manner as to penetrate the conveyance belt 43 in its thickness direction. The outer circumferential surface 44 includes a supporting surface 44*a* (one example of a recording medium supporting surface) that supports the sheet P. The plurality of holes 45 are provided in such a manner as to be dispersed over the whole of the outer circumferential surface 44.

Figure 3A:
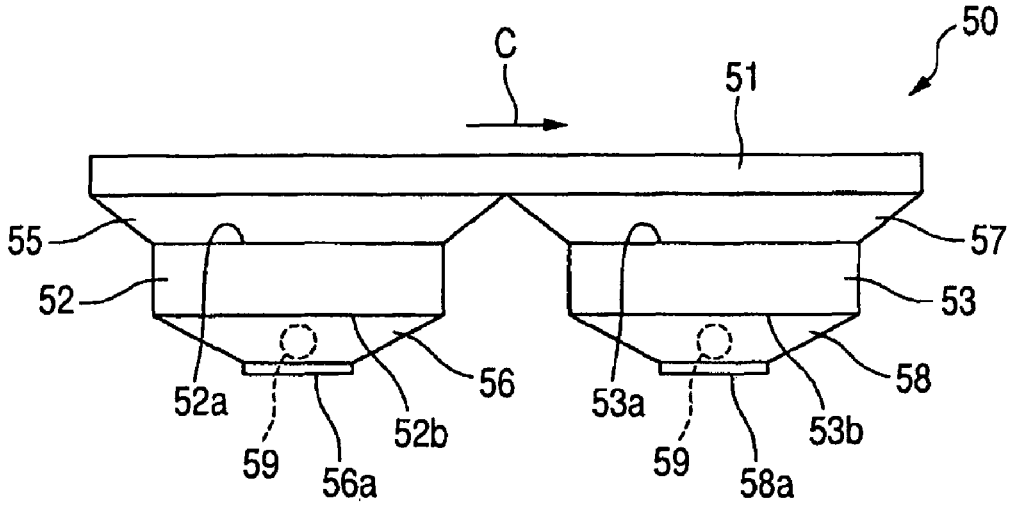
FIG. 3A is a side view of the suction unit, and 3B is a front view of the suction unit.
Figure 3B:
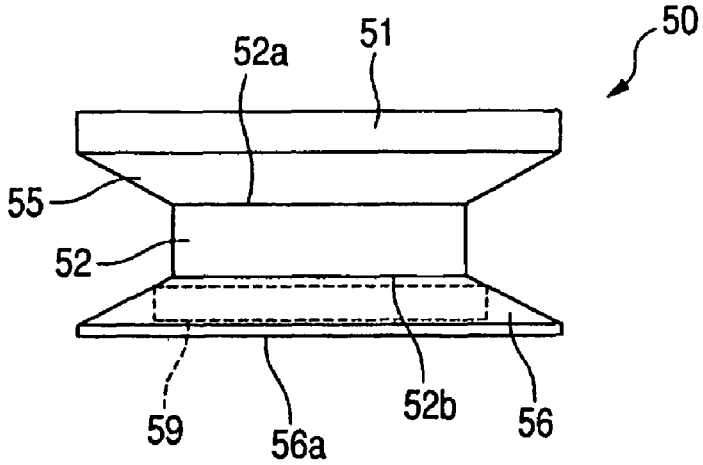

As is shown in FIG. 1, a suction unit 50 is provided within an area (i.e., an inside of the conveying unit 40) which is surrounded by the conveyance belt 43 in a position where the suction unit 50 confronts the inkjet heads 2. As is shown in FIGS. 3A and 3B, the suction unit 50 has a substantially rectangular parallelepiped platen 51, two rotary fans 52, 53 which are provided below the platen 51, two ducts 55, 56 which are connected to the rotary fan 52 and two ducts 57, 58 which are connected to the rotary fan 53. In addition, the two ducts 57, 58 which are connected to the rotary fan 53 have a similar configuration to that of the two ducts 55, 56 which are connected to the rotary fan 52. Therefore, although the detailed description thereof will be omitted here, the same advantage as that which can be obtained with the two ducts 55, 56 (which will be described later) can be obtained with the two ducts 57, 58.

As is shown in FIG. 2, a plurality of holes 51*a* are formed in such a manner as to spread over the whole of an upper surface of the platen 51 while penetrating through the platen 51 in its thickness direction. An opening of the hole 51*a* is sized to encompass just four holes 45 which are confronted by the hole 51*a*. The platen 51 is formed slightly longer than the lengths of the sheet P and the conveyance belt 43 with respect to a direction which is at right angles to the conveying direction C (a vertical direction as viewed in FIG. 2). In addition, as is shown in FIG. 1, the upper surface of the platen 51 is in contact with an inner circumferential surface of an upper part of the conveyance belt 43 which is looped round the belt rollers 41, 42, so as to support the conveyance belt 43 from an inner circumferential side thereof. By this configuration, an outer circumferential surface 44 of the upper part of the looped conveyance belt 43 and lower surfaces or discharge surfaces 2*a* of the inkjet heads 2 are made square to each other in an opposed fashion, and a slight gap is formed between the discharge surfaces 2*a* and the outer circumferential surface 44 of the conveyance belt 43. This gap constitutes part of the sheet conveying line.

As is shown in FIGS. 3A and 3B, the two rotary fans 52, 53 have a substantially rectangular parallelepiped shape. The rotary fans 52, 53 are devices which are configured in such a manner that by rotary vanes provided in interiors thereof being rotated, air is drawn from suction openings 52*a*, 53*a* formed in upper surfaces thereof to be discharged from discharge openings 52*b*, 53*b* (each of which is one example of a fan-side discharge opening) which are formed in lower surfaces thereof. These rotary fans 52, 53 are provided in parallel along the conveying direction C. That is, the discharge openings 52*b*, 53*b* of the rotary fans 52, 53 are provided in such a manner as to be aligned along the conveying direction C. In addition, the rotary fans 52, 53 are controlled by the control unit 100.

The duct 55 connects the platen 51 and the rotary fan 52 together and establishes a communication between the plurality of holes 51*a* which are formed in a half area of the platen 51 and the suction part 51*a* of the rotary fan 52. As is shown in FIG. 1, the duct 56 extends downwards from a lower end of the rotary fan and discharges air discharged from the discharge opening 52*b* of the rotary fan 52 downwards. That is, the duct 56 introduces air to a conveyance guide 66 (which will be described later) of the re-conveying unit 60 through the holes 45 in the conveyance belt 43, whereby air can efficiently be discharged toward a sheet P which is being conveyed by the re-conveying unit 60.

In addition, the duct 56 has a tapered shape, and a discharge opening 56*a* of the duct 56 (one example of a duct-side discharge opening) is made to have a smaller opening area than that of the discharge opening 52*b* of the rotary fan 52. By this configuration, a discharge speed of air discharged from the discharge opening 56*a* is increased to a faster speed than that resulting in the vicinity of the discharge opening 52*b*. Because of this, drying of an image formed on a sheet P that is being conveyed by the re-conveying unit 60 is promoted further. In addition, as is shown in FIG. 3B, the discharge opening 56*a* of the duct 56 has a length which is almost the same as a length of the platen 51 with respect to a direction which is at right angles to the conveying direction C (a vertical direction as viewed in FIG. 2). That is, the discharge opening 56*a* has the length which is equal to or longer than the length of the sheet P as viewed in the direction in question. By this configuration, air can be discharged over the whole of a sheet P which is being conveyed by the re-conveying unit 60 with respect to the direction which is at right angles to the conveying direction C.

Heaters 59 are provided in interiors of the duct 56 and the duct 58 for heating air discharged from the discharge openings 52*b*, 53*b* of the rotary fans 52, 53. By providing the heaters 59 in the interiors of the ducts 56, 58, air that is to be discharged from the discharge openings 56*a*, 58*a* of the ducts 56, 58 can be heated. Because of this, drying of an image formed on a sheet that is being conveyed by the re-conveying unit 60 can be promoted further. The heaters 59 are a heating wire such as a nichrome wire or a halogen heater and are controlled to be energized by the control unit 100 to thereby heat air residing inside the ducts 56, 58.

A hold-down roller 47 is provided in a position lying upstream of the inkjet head 2 which is provided most upstream with respect to the conveying direction C and confronting the belt roller 41 for holding down a sheet P fed out from the sheet feeding unit 23 on to the outer circumferential surface 44. The hold-down roller 47 is pressed against the outer circumferential surface 44 by means of an elastic member such as a spring. In addition, the hold-down roller 47 is an idler roller and rotates as the conveyance belt 43 runs in a rating fashion. Additionally, a sheet sensor 71 is provided between the hold-down roller 47 and the inkjet head 2. This sheet sensor 71 detects a front or leading end of the sheet P which is held down by the hold-down roller 47.

In this configuration, the conveyance belt 43 runs in the rotating fashion by the belt roller 42 being controlled to rotate in a clockwise direction as viewed in FIG. 1 by the control unit 100. As this occurs, the belt roller 41 and the hold-down roller 47 also rotate in conjunction with rotation of the conveyance belt 43. In addition, as this occurs, when the rotary fans 52, 53 are controlled to be driven by the control unit 100 so as to draw air from all the holes 51*a* through the ducts 55, 57, the sheet P fed out from the sheet feeding unit 23 is conveyed in the conveying direction C while being drawn to be caused to stick to the outer circumferential surface 44. Further, as this occurs, when the sheet P which has been conveyed while being held on to the outer circumferential surface 44 of the conveyance belt 43 passes sequentially directly underneath the four inkjet heads 2, the control unit 100 controls the inkjet heads 2 to discharge inks in corresponding colors toward the sheet P. In this way, a desired color image is formed on the sheet P.

A separation member 5 is provided directly downstream of the conveying unit 40 in the conveying direction C. The separation member 5 separates the sheet P from the outer circumferential surface 44 by a distal end thereof being wedged between the sheet P and the conveyance belt 43.

As is shown in FIG. 1, conveyance guides 33*a*, 33*b* and two pairs of forwarding rollers 34, 35 are provided to the right of the inkjet heads 2. The conveyance guides 33*a*, 33*b* configure part of the re-conveying unit 60 and extend from the conveying unit 40 toward the sheet discharging part 3 while being curved. Note that one of each of the pairs of forwarding rollers 34, 35 is driven to rotate by a corresponding forwarding motor of forwarding motors 124, 125 (refer to FIG. 4), and the other roller is an idler roller which rotates in conjunction with rotation of the one roller. In addition, the forwarding motors 124, 125 are controlled by the control unit 100. Additionally, a sheet sensor 72 is provided in the vicinity of the pair of forwarding rollers 34. This sheet sensor 72 detects a rear or trailing end of a sheet P which has been conveyed from the conveying unit 40.

In this configuration, by the respective pairs of forwarding rollers 34, 35 being controlled to rotate in predetermined directions by the control unit 100, the sheet P which has been discharged from the conveying unit 40 is made to pass along the conveyance guides 33*a*, 33*b* while being held between the pairs of forwarding rollers 34, 35 to thereby be sent upwards and are then discharged on to the sheet discharging part 3. As this occurs, when the sheet P is not discharged on to the sheet discharging part 3 but an image is attempted to be formed on a rear side of the sheet P (a rear surface of the sheet P a front surface of which an image has already been formed), that is, images are formed on both surfaces of the sheet P and the image formed on the front surface of the sheet P is attempted to be dried, the respective pairs of forwarding rollers 34, 35 are controlled to rotate in reverse directions to the predetermined directions by the control unit 100 at a point in time at which the rear end of the sheet P has arrived near the pair of forwarding rollers 34, whereby the sheet P is conveyed in the reverse direction (downwards as viewed in FIG. 1).

As is shown in FIG. 1, in addition to the conveyance guides 33*a*, 33*b* and the two pairs of forwarding rollers 34, 35, the re-conveying unit 60 has three pairs of forwarding rollers 61 to 63, a conveyance guide 64 which is provided between the pair of forwarding rollers 34 and the pair of forwarding rollers 61 for guiding the sheet P which is being conveyed in the reverse direction, a conveyance guide 65 which is provided between the pairs of forwarding rollers 61, 62, a conveyance guide 66 which is provided between the pairs of forwarding rollers 62, 63, and a conveyance guide 67 which is provided between the pair of forwarding rollers 63 and the pair of forwarding rollers 32 and which merges into the conveyance guide 31*a*. Note that one of each of the respective pairs of forwarding rollers 61 to 63 is also driven to rotate by a corresponding forwarding motor of forwarding motors 126 to 128 (refer to FIG. 4), and the other roller is an idler roller which rotates as the one roller rotates. In addition, the forwarding motors 126 to 128 are controlled by the control unit 100. Additionally, sheet sensors 73, 74 are provided in the vicinity of the pairs of forwarding rollers 62, 63, respectively. These sheet sensors 73, 74 detect a front end of a sheet P which is being conveyed by the re-conveying unit 60.

In this configuration, by the respective pairs of forwarding rollers 61 to 63 being controlled to rotate by the control unit 100, the sheet P which has been conveyed in the reverse direction from the sheet discharging part 3 side are made to pass along the conveyance guides 64 to 67 while being held between the respective pairs of forwarding rollers 61 to 63 to thereby be conveyed to the pair of forwarding rollers 32. As this occurs, when the rotary fans 52, 53 are controlled to be driven so as to draw air from the holes 51*a* through the ducts 55, 57 by the control unit 100, air drawn into from the discharge openings 56*a*, 58*a* of the ducts 56, 58 is discharged to the conveyance guide 66 through a plurality of holes 45 provided in a lower part of the looped conveyance belt 43. Air discharged to the conveyance guide 66 is blown against the front surface of the sheet P on which the image is formed, whereby drying of the image in question is promoted. In addition, as this occurs, when the heaters 59 are controlled to be energized by the control unit 100, heat inside the ducts 56, 58 is heated, whereby hot air can be blown against the front surface of the sheet P passing along the conveyance guide 66, the drying of the image formed thereon can be promoted further. Thereafter, by the pair of forwarding rollers 32 being controlled to rotate by the control unit 100, the sheet P on the front surface of which the image is formed is conveyed to an upstream end of the conveying unit 40 in the conveying direction C. As this occurs, the sheet P is conveyed on to the conveying unit 40 in such a state that the sheet P is turned over upside down from the state resulting when the sheet P was fed out from the sheet feeding unit 23.

Figure 4:
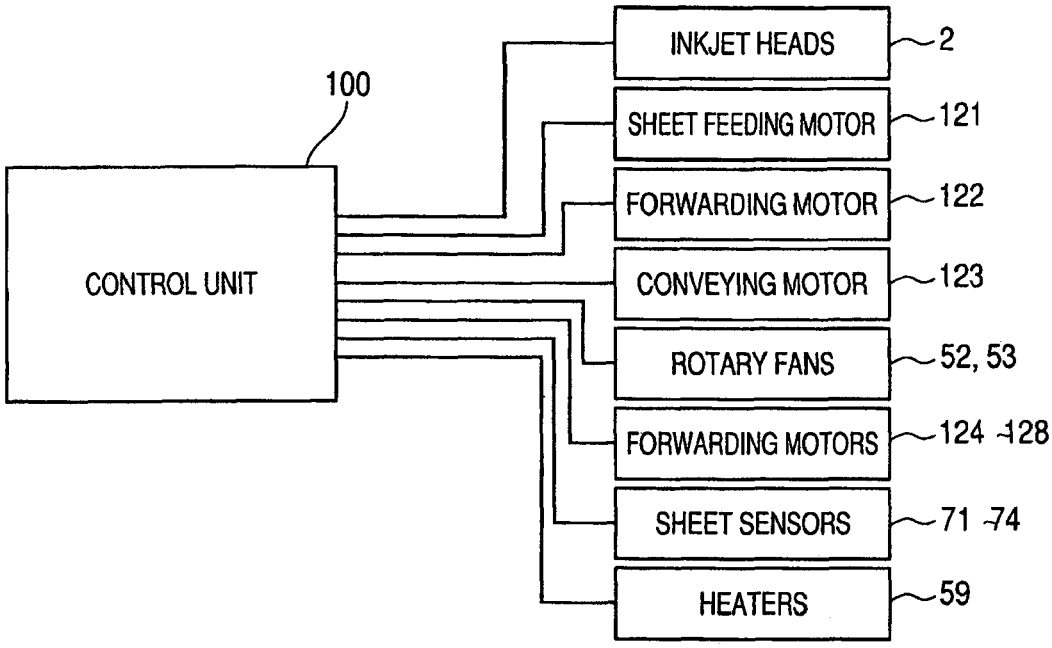
FIG. 4 is a control system diagram of the inkjet printer shown in FIG. 1.

Next, the control unit 100 will be described. FIG. 4 is a control system diagram of the inkjet printer 1 shown in FIG. 1. The control unit 100 is made up, for example, of a general-purpose personal computer. Hardware such as a CPU, ROM, RAM and hard disk is installed in the computer, and software of various types including a program which controls the operation of the printer 1 is stored in the hard disk. Then, the inkjet heads 2 and the respective motors 121 to 128 are controlled by the control unit 100. Additionally, the four sheet sensors 71 to 74 are connected to the control unit 100, and detection signals from the respective sensors 71 to 74 are transmitted to the control unit 100.

Figure 5A:
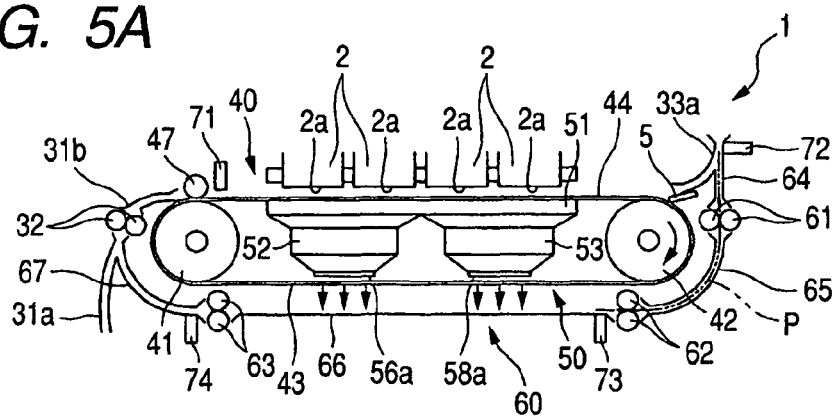
FIGS. 5A to 5C are explanatory diagrams explaining the operation of the inkjet printer when a sheet is conveyed by a re-conveying unit.
Figure 5B:
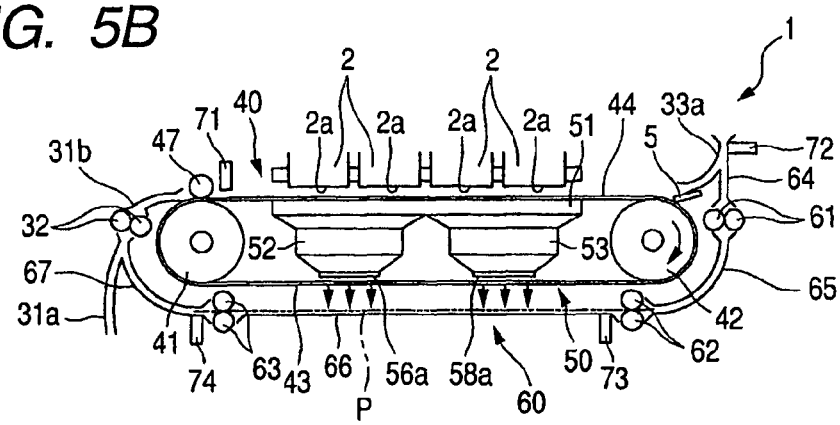
Figure 5C:
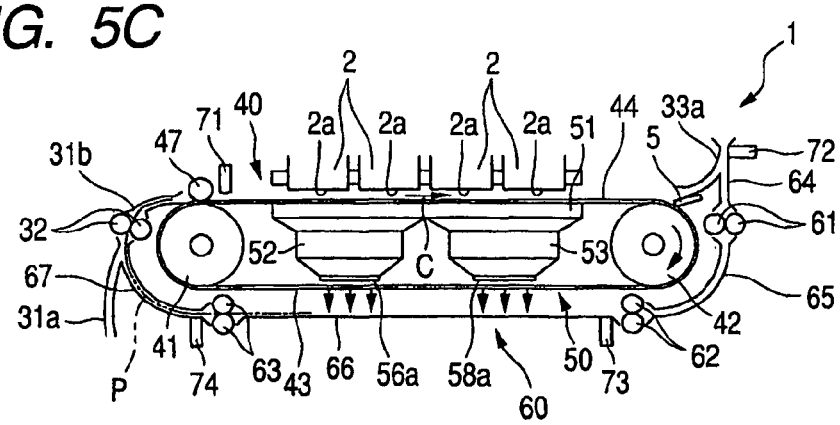

Next, referring to FIG. 1 and FIGS. 5A to 5C, a printing operation of the printer 1, or, specifically, an operation will be described which occurs when the sheet P is conveyed to the conveying unit 40 again by the re-conveying unit 60. FIGS. 5A to 5C are explanatory diagrams explaining an operation which occurs when the sheet P is conveyed by the re-conveying unit 60 within the inkjet printer 1.

In FIG. 1, when print data for forming images on both sides (that is, a front surface and a rear surface) of a sheet P is transmitted to the control unit 100 from a PC (personal computer) or the like, the control unit 100 activates the sheet feeding motor 121 and the forwarding motor 122 so that a sheet P is fed from the sheet feeding cassette 24 to the conveying unit 40 via the conveyance guides 31*a*, 31*b*.

Next, the control unit 100 activates the conveying motor 123 so that the sheet P is conveyed in the conveying direction C along thick black arrows shown in FIG. 1. As this occurs, when a front end of the sheet P is detected by the sheet sensor 71, the control unit 100 activates the rotary fans 52, 53 so that the sheet P which is being conveyed by the conveyance belt 43 is drawn to be caused to stick to the outer circumferential surface 44. In addition, as this occurs, the control unit 100 controls the respective inkjet heads 2 so that the inks are discharged from the inkjet heads 2 after a predetermined period of time has elapsed during which the sheet P travels from the point where a front end thereof is detected by the sheet sensor 71 and passes through the area confronting the respective inkjet heads 2. In this way, an image is formed in a desired position on the sheet P.

Next, the control unit 100 activates the pairs of forwarding rollers 34, 35 so that the sheet P on the front surface of which the image is formed is conveyed to the sheet discharging part 3 side after having passed along the conveyance guides 33*a*, 33*b*. Then, when the rear end of the sheet P is detected by the sheet sensor 72, the control unit 100 controls the pairs of forwarding rollers 34, 35 to rotate in the reverse directions to the directions in which they were rotated previously. Thus, the sheet P is conveyed toward the re-conveying unit 60 along thick white arrows shown in FIG. 1. As this occurs, the control unit 100 controls the heaters 59 to heat air inside the ducts 56, 58.

Next, the control unit 100 activates the three pairs of forwarding rollers 61 to 63 so that the sheet P is conveyed to the pair of forwarding rollers 32 by passing along the conveyance guides 64 to 67. As this occurs, as is shown in FIG. 5A, when the front end of the sheet P in the conveying direction is detected by the sheet sensor 73, the control unit 100 controls the rotation of the pairs of forwarding rollers 61 to 63 so that the conveying speed of the sheet P by the pairs of forwarding rollers 61 to 63 becomes slower than the conveying speed of the sheet P by the pair of forwarding rollers 34. In other words, in the re-conveying unit 60, the conveying speed of the sheet P is controlled by the control unit 100 so as to be slower in the position where air is discharged from the suction unit 50 (the position of the conveyance guide 66) than in the position where air is not discharged from the suction unit 50 (the position where the sheet is conveyed by the pair of forwarding rollers 34). In addition, when the front end of the sheet P in the conveying direction is detected by the sheet sensor 73, the rear end of the sheet P lies in the position where the rear end just confronts the sheet sensor 72 and has passed by the pair of forwarding rollers 34.

As this occurs, too, since the conveyance belt 43 continues to run in the rotating fashion and the rotary fans 52, 53 are also kept driven, air discharged from the discharge openings 56*a*, 58*a* of the ducts 56, 58 is blown against the front surface (the surface confronting the discharge openings 56*a*, 58*a*) of the sheet P which is being conveyed between the pairs of forwarding rollers 62, 63 through the holes of the plurality of holes 45 formed in the conveyance belt 43. In this way, drying of the image formed on the front surface of the sheet P is promoted. Further, since the conveying speed of the sheet P in the position where air is blown thereagainst from the suction unit 50 is made slower, a time during which air is blown against the front surface of the sheet P is made longer, whereby the drying of the image is promoted further.

In addition, as is shown in FIG. 5B, when the front end of the sheet P is detected by the sheet sensor 74, the control unit 100 controls the pairs of forwarding rollers 62, 63 so that the driving thereof is stopped only for a predetermined period of time. By adopting this configuration, the time during which air is blown against the front surface of the sheet P is made much longer, whereby the drying of the image is promoted much further.

As a first modified example, a configuration may be adopted in which the conveying speed of the sheet P is kept constant until the front end of the sheet P is detected by the sheet sensor 74, and when the front end of the sheet P is detected by the sheet sensor 74, the control unit 100 stops the driving of the pairs of forwarding rollers 62, 63 only for the predetermined period of time. In this case, the sheet sensor 73 does not have to be provided. As a second modified example, a configuration may be adopted in which the conveying speed of the sheet P is made slower as with the exemplary embodiment only for a period of time from the front end of the sheet P is detected by the sheet sensor 73 until the front end of the sheet P is detected by the sheet sensor 74. As this occurs, even though the front end of the sheet P is detected by the sheet sensor 74, the conveyance of the sheet P is not stopped. In either of the modified examples, the conveying time in the re-conveying unit 60 is made shorter than that of the exemplary embodiment. Further, as a third modified example, a configuration may be adopted in which when a rear end of a sheet P that has been conveyed downwards from the sheet discharging part 3 side is detected by the sheet sensor 72 before a front end of the sheet P in question is detected by the sheet sensor 73, that is, when a sheet P is used whose size is smaller than that of the sheet P of the exemplary embodiment, the control unit 100 stops the driving of either of the rotary fans 52, 53 which are being driven. In this way, the rotary fans 52, 53 can be driven in accordance with the size of the sheet P used, this contributing to conservation of electric power.

Next, as is shown in FIG. 5C, the control unit 100 activates the pairs of forwarding rollers 62, 63 so as to convey the sheet P toward the pair of forwarding rollers 32. As this occurs, too, since the pair of forwarding rollers 32 is kept driven, the sheet P that has been conveyed by the pair of forwarding rollers 32 is conveyed to the upstream end of the conveying unit 40 in the conveying direction C. Thereafter, as with the occasion where the image formed on the front surface of the sheet P, the control unit 100 controls the inkjet heads 2 so as to form a desired image on a rear surface of the sheet P. Then, the control unit 100 controls the pairs of forwarding rollers 34, 35 so as to discharge the sheet P on both the surfaces of which the images are formed on to the sheet discharging part 3. In this way, the printing operation on the sheet P is completed.

In the above-described exemplary embodiments, while the case is described in which the images are formed on both the sides of the sheet P, also in a case where print data including data for forming an image by discharging a predetermined amount or more of inks to a predetermined area on a sheet P is transmitted to the control unit 100, as with the aforesaid case, the sheet P is conveyed by the re-conveying unit 60 so that air discharged from the discharge openings 56*a*, 58*a* is blown against the sheet P. That is, when printing is made only on a front surface (one side) of the sheet and the predetermined amount or more of inks is discharged to the predetermined area on the front surface of the sheet P, after an image has been formed on the front surface of the sheet P, the sheet P is conveyed by the re-conveying unit 60 so that air discharged from the discharge openings 56*a*, 58*a* is blown against the surface of the sheet P. Thereafter, the sheet P is conveyed in the conveying direction C by the conveying unit 40, so that the sheet P is discharged on to the sheet discharging part 3. In addition, when a predetermined amount or more of inks is discharged to a predetermined area on a reverse side of an already-printed sheet P in perfecting, also after the image has been formed on the reverse side of the sheet P, the sheet P is conveyed by the re-conveying unit 60 so that air discharged from the discharge openings 56*a*, 58*a* is blown against the reverse side of the sheet P. Thereafter, the sheet P is conveyed in the conveying direction C by the conveying unit 40, so as to be discharged on to the sheet discharging part 3. Also in these cases, the drying of the images is promoted in the same fashion as has been described above.

As has been described heretofore, according to the inkjet printer 1 of the exemplary embodiment of the invention, by making use of the suction unit for drawing a sheet P so as to cause it to stick to the conveyance belt 43, air is enabled to be discharged to a sheet that is being conveyed by the re-conveying unit 60, so as to promote the drying of an image or images formed on the sheet P. Because of this, the necessity is obviated of providing separately a device for promoting the drying of an image or images on a sheet P, and hence, an increase in the number of the components can be suppressed.

In addition, by providing the rotary fans 52, 53 in the inside of the conveying unit 40, the interior space (the dead space) of the conveying unit 40 can effectively be used. Should the rotary fans 52, 53 be provided outside the conveying unit 40, a space has to be secured inside the printer where to provide the rotary fans 52, 53 and a long duct for drawing air from the holes 45 through the holes 51*a* in the platen 51, and this enlarges the size of the printer. However, by making effective use of the dead space as in the invention, the inkjet printer 1 can be made smaller in size.

In addition, since air is made to be blown against the sheet P that has been conveyed by the re-conveying unit 60 through the plurality of holes 45 which do not confront the inkjet heads 2 but confront the re-conveying unit 60 in the plurality of holes 45 in the conveyance belt 43, the air introduction line can be made simple in construction which is adapted to for introduce air discharged from the rotary fans 52, 53 to the re-conveying unit 60. That is, the necessity of a long duct can be obviated which causes air discharged from the rotary fans 52, 53 to bypass the holes 45. In addition, since the re-conveying unit 60 is provided adjacent to the suction unit 50 below the conveyance belt 43, the air introduction line for introducing air discharged from the rotary fans 52, 53 to the re-conveying unit 60 can be made simple.

While the invention has been shown and described with reference to certain exemplary embodiments thereof, it will be understood by those skilled in the art that various changes in form and details may be made therein without departing from the spirit and scope of the invention as defined by the appended claims.

For example, in the above-described exemplary embodiment, the suction unit 50 is provided inside the conveyance belt 43. Alternatively, a configuration may be adopted in which the suction unit is provided outside the conveying unit 40 and has rotary fans, ducts which link suction openings of the rotary fans with the lower surface of the platen 51 and ducts which are connected to discharge openings of the rotary fans and made to extend to a position where air from the discharge openings is blown against a sheet P that is being conveyed by the re-conveying unit 60. In addition, the re-conveying 60 may be provided below the sheet feeding unit 23. That is, a component of the printer may be provided between the conveying unit 40 and the re-conveying unit 60.

Further, in the above-described exemplary embodiments, when perfecting is carried out on the sheet P, the sheet P is conveyed by the re-conveying unit 60 so that air discharged from the discharge openings 56*a*, 58*a* is blown against the sheet P to thereby promote drying of the images formed on both the sides thereof in perfecting. Alternatively, in the event that the image formed on the front surface of the sheet does not have to be so dried (for example, in the event that an image that is to be formed on the front surface is formed by a minute amount of inks), the rotary fans 52, 53 may not have to be driven on any other occasions than the occasion in which the sheet P is being conveyed by the conveying unit 40. That is, when perfecting is carried out, the sheet P may be conveyed by the re-conveying unit 60 in such a state that air is discharged from the discharge openings 56*a*, 58*a*.

In the above-described exemplary embodiments, the conveying speed of the sheet P by the re-conveying unit 60 is made slower in the position where air is blown against the sheet P. Alternatively, the re-conveying unit 60 may be made to convey the sheet P at a constant speed at all times. In addition, while the plurality of holes 45 of the same size are formed in the conveyance belt 43 in the above-described exemplary embodiments, the conveying unit may have a conveying part in which a plurality of first holes for drawing a sheet P so as to cause it to stick to the endless outer circumferential surface and a plurality of second holes having a large opening area than that of the first holes. In this case, the outer circumferential surface is divided into two areas therealong of a supporting area where the sheet P is supported and a non-supporting area where the sheet P is not supported, and the plurality of first holes are formed in the supporting area, while the plurality of second holes are formed in the non-supporting area. In addition, by causing the conveyance part to rotate so that the sheet P that is being conveyed by the re-conveying unit 60 and the non-supporting area confront each other in synchronism with the conveyance of the sheet P by the re-conveying unit 60, air discharged from the suction unit 50 is blown against the sheet P by passing through the second holes 2 having the larger opening area. Because of this, the amount of air blown against the sheet P is increased compared with when air is blown against the sheet by passing through the first holes, whereby drying of an image or images formed on the sheet P is promoted.

In addition, the suction unit 50 may not have to have the ducts 55 to 58. Additionally, the heaters may not have to be provided in the interiors of the ducts 56, 58.

Additionally, in place of an endless belt like the conveyance belt 43, the conveying mechanism for conveying a sheet P may have a drum adapted to convey a sheet P by rotating in a circumferential direction with the sheet P held on to an outer circumferential surface thereof and a platen adapted to travel in the conveying direction with the sheet P held on a flat conveying surface thereof. As this occurs, suction holes may be formed in the outer circumferential surface and the conveying surface on to which the sheet P is held.

The application of the recording apparatus according to the invention is limited neither to the inkjet type recording apparatus nor the in-line type recording apparatus, and hence, the recording apparatus of the invention can also be applied to a serial type recording apparatus. In addition, the application of the recording apparatus of the invention is not limited to the printer but can be expanded to facsimiles and copying machines.

What is claimed is:

1. A recording apparatus comprising: a recording unit that forms an image on a recording medium; a recording medium conveying unit, which confronts the recording unit, and which comprises a recording medium supporting surface including a hole; a suction unit that draws air through the hole to draw the recording medium in order to stick the recording medium to the recording medium supporting surface; and a re-conveying unit that re-conveys the recording medium to an upstream of the recording medium conveying unit in a conveying direction, wherein the suction unit discharges air toward the recording medium that is being conveyed by the re-conveying unit.

2. The recording apparatus according to claim 1, wherein the recording medium conveying unit comprises a conveying part, a surface of which includes the recording medium supporting surface, and which has an endless shape, and wherein the suction unit comprises a rotary fan that is provided inside of the conveying part.

3. The recording apparatus according to claim 2, wherein the recording medium conveying unit comprises a first side that confronts the recording unit and a second side that is opposite to the first side, wherein the surface of the conveying part comprises a plurality of holes, and wherein the suction unit discharges air through holes of the plurality of holes provided on the second side.

4. The recording apparatus according to claim 3, wherein the re-conveying unit is provided in a position where the re-conveying unit lies adjacent to the conveying part and where the conveying part is sandwiched between the recording part and the re-conveying unit.

5. The recording apparatus according to claim 2, wherein the suction unit comprises a plurality of rotary fans and a plurality of fan-side discharge openings, and wherein the plurality of fan-side discharge openings are aligned along the conveying direction.

6. The recording apparatus according to claim 1, wherein the re-conveying unit conveys the recording medium at a first speed in a position where air is discharged from the suction unit toward the recording medium, wherein the re-conveying unit conveys the recording medium at a second speed in a position where air is not discharged from the suction unit toward the recording medium, and wherein the first speed is made slower than the second speed.

7. The recording apparatus according to claim 1, wherein the suction unit comprises: a rotary fan comprising a fan-side discharge opening; and a duct that introduces air from the fan-side discharge opening to the re-conveying unit.

8. The recording apparatus according to claim 7, wherein the duct comprises a duct-side discharge opening, which has a length equal to or longer than a length of a recording medium in a direction orthogonal to the conveying direction.

9. The recording apparatus according to claim 7, wherein the duct comprises a duct-side discharge opening, an opening area of the duct-side discharge opening being smaller than an opening area of the fan-side discharge opening.

10. The recording apparatus according to claim 1, wherein the suction unit comprises a heater that heats air which is discharged toward the recording medium conveyed by the re-conveying unit.

11. The recording apparatus according to claim 1, wherein the suction unit comprises: a first side that confronts the recording unit; a second side that is opposite to the first side and confronts the re-conveying unit; and a rotary fan that sucks air from the first side and discharges the air toward the second side.

12. The recording apparatus according to claim 11, wherein the suction unit further comprises: a suction hole provided in the first side; and a discharge opening provided in the second side, and wherein the rotary fan is provided between the suction hole and the discharge opening.

13. The recording apparatus according to claim 12, wherein the recording medium supporting surface comprises a plurality of holes, wherein the suction unit comprises a plurality of suction holes, and wherein an opening area of each of the plurality of holes is made smaller than an opening area of each of the plurality of suction holes.

14. The recording apparatus according to claim 1, wherein the suction unit comprises: a first side confronting the recording unit and a second side confronting at least a portion of the re-conveying unit; wherein the suction unit is configured to suck air from the first side and to discharge air toward the second side.

* * * * *